United States Patent [19]

Burton

[11] 4,232,455

[45] Nov. 11, 1980

[54] DRYER DRUM CONDENSATE REMOVAL APPARATUS

[75] Inventor: Frank Burton, Baldingstone, England

[73] Assignee: Beloit Corporation, Beloit, Wis.

[21] Appl. No.: 902,169

[22] Filed: May 2, 1978

[30] Foreign Application Priority Data

Dec. 3, 1977 [GB] United Kingdom ..... 50440/77

[51] Int. Cl.[3] ..... F28F 5/02

[52] U.S. Cl. ..... 34/124; 34/125; 165/81; 165/90

[58] Field of Search ..... 34/119, 124, 125; 165/90, 81; 137/124, 152

[56] References Cited

U.S. PATENT DOCUMENTS

| | | | |
|---|---|---|---|
| 661,353 | 11/1900 | White et al. | 34/124 |
| 680,040 | 8/1901 | Harleman | 34/124 |
| 1,163,224 | 12/1915 | Dodge | 34/124 |
| 1,640,019 | 8/1927 | Young | 34/124 |
| 1,664,656 | 4/1928 | Berry | 34/125 |
| 2,297,094 | 9/1942 | Armstrong et al. | 34/124 |
| 2,521,371 | 9/1950 | Hornbostel et al. | 34/125 |
| 3,241,251 | 3/1966 | Justus et al. | 34/124 |
| 3,299,530 | 1/1967 | Eiss et al. | 34/124 |
| 3,359,647 | 1/1966 | Webb | 34/124 |
| 3,363,328 | 1/1968 | Dickens et al. | 34/124 |
| 3,473,238 | 10/1969 | Talley, Jr. et al. | 34/125 |
| 3,481,050 | 12/1969 | Cox, Jr. | 34/124 |
| 3,553,849 | 1/1971 | Carrier et al. | 34/124 |
| 3,601,902 | 8/1971 | Schiel | 34/124 |
| 3,659,349 | 5/1972 | Nykopp | 34/124 |
| 3,802,093 | 4/1974 | Ebeling | 34/124 |

FOREIGN PATENT DOCUMENTS

| | | | |
|---|---|---|---|
| 417582 | of 1947 | Italy | 34/124 |
| 17946 | 7/1899 | United Kingdom | 34/119 |
| 863427 | 3/1961 | United Kingdom | 34/125 |
| 1370579 | 10/1974 | United Kingdom . | |

*Primary Examiner*—William E. Wayner
*Assistant Examiner*—Harold Joyce
*Attorney, Agent, or Firm*—Hill, Van Santen, Steadman, Chiara & Simpson

[57] ABSTRACT

A dryer drum for a paper making machine with a shell and end heads and steam delivery means and a plurality of headers extending axially and uniformly circumferentially spaced a relatively short length each carrying a row of dipper straws projecting adjacent the inner surface of the shell with the headers fixed to the shell surface and flexible tubes connecting the headers to a main conduit for removal of the condensate.

1 Claim, 7 Drawing Figures

DRYER DRUM CONDENSATE REMOVAL APPARATUS

BACKGROUND OF THE INVENTION

The present invention relates to improvements in dryer drums for paper making machines, and more particularly to an improved mechanism for removing the water condensate which forms on the inner surface of the drum shell from condensing steam and which reduces the heat transfer from the steam within the shell to the surface of the shell for drying a traveling fibrous web.

In a drying drum for a paper making machine, the mechanism includes a cylindrical shell with heads that have shafts for rotational mounting of the drum. A steam supply gland is provided to direct heated steam into the interior of the drum and generally dipper tubes or straws are positioned adjacent the inner surface of the drum to remove condensate which forms against the drum. In the formation of a relatively wide web of paper, the length of the drums has to be substantial, and it is essential for uniform drying that the drum have uniform heat along its length. Since the layer of condensate which forms within the drum reduces heat transfer from the steam to the metal of the drum shell, it is essential that this condensate layer be maintained as thin as possible, but more importantly, that it may be maintained of uniform thickness because if nonuniformity exists, different rates of heat transfer will exist along the length of the drum resulting in temperature differences and differences in dryness of the paper web along its width.

It is accordingly an object of the present invention to provide a means for removing a maximum amount of rimming condensate and removing it very uniformly to maintain a uniform thickness layer and to avoid the adverse effects of heat expansion and contraction which change the spacing between the condensate removal means and the inner surface of the drum shell.

Drying drums for paper making machines are often provided internally with narrow circumferential grooves spaced axially along the inner surface of the shell to leave a series of ribs or lands therebetween. These ribs strengthen the relatively thin shell of the dryer drum, and permit the safe use of a significantly thinner shell through which heat transfer is improved with a consequent increase in efficiency of the drying action on the paper or other web. Condensate is removed from within such drying cylinders through one or more header tubes carrying a plurality of dipper pipes or straws extending into the grooves and drawing off the condensate as it collects in such grooves.

It has been found that, with wide machines having axially long drying cylinders, uneven moisture profiles of the dried web are often present, due to an uneven drying effect across the width of the machine. This uneveness is undesirable, particularly in thin webs, such as tissues, and it is believed that it results from uneven extraction of the condensate due to distortion of the dipper-carrying, condensate-removal header pipes. If, as is generally the case, these pipes are of substantial length, extending across substantially the full axial length of the cylinder, there is a tendency for them to distort locally when hot, and their spacing relative to the inner periphery of the cylinder shell to vary across the width of the cylinder. In this way the positioning of the dipper tubes or straws within the grooves varies, and hence condensate removal through these tubes may vary across the cylinder, producing temperature gradients across the smooth outer drying surface of the cylinder. Attempts to minimize this disadvantage by altering the lengths of the dipper tubes or straws has proved unsuccessful as the temperature gradient across the cylinder may vary according to running conditions of the machine.

The present invention seeks to obviate or reduce the aforementioned difficulty by maintaining the setting distance between the end of each dipper and the inner surface of its associated groove in the shell of the dryer thereby to achieve an even depth of condensate layers. This is achieved by splitting the dipper-carrying tubes into several individual sections, each serving a part-only of the condensate removal across the width of the cylinder, whereby any distortion is minimized.

According to the present invention the dipper tubes or straws across the or each condensate collection region within an internally grooved drying cylinder are carried from a plurality of individual short header tubes which together extend across substantially the whole axial width of the cylinder at said collecting region, the individual short header tubes being connected to one or more common header pipes arranged to lead condensate away from the individual short header tubes into a condensate discharge.

Conveniently the short header tubes are slightly staggered across the width of the cylinder at the or each collection region to facilitate mounting of the tubes while still ensuring that each groove across the region has a dipper tube or straw projecting therein.

Preferably the connections between each short header tube and the common header pipe are flexible, and this eliminates or reduces problems resulting from expansion of the tubes and pipes.

The short header tubes are fastened to the shell locally and hence are able to follow changes in the shape of the dryer resulting from the application of a wet sheet thereto which tends to cause distortion of the dryer especially at the ends. With this local fastening it is possible to maintain the same accurate setting distance of the dipper tubes or straws within their respective grooves. An additional advantage stems from the use of separate common header pipes because flooding of the header in the vicinity of the riser tubes is thereby avoided.

By using a plurality of short header tubes overall manufacture is less exacting inasmuch as accurate location of the dipper tubes or straws within the grooves is less difficult with the short sections than with a single long length. Moreover, the use of short sections of header tube enables internal erosion plates to be changed without removing the headers from the shell.

While the above discussion relates primarily to dryer cylinders or drums which have grooves on the inner surface, the concepts of the invention apply equally to drums which have a smooth inner surface inasmuch as the objective must be to maintain uniform heat transfer from the steam to the metal of the drum shell at all axial locations and to maintain this by maintaining a uniform thickness of condensate at all axial locations along the drum length. It is an object of the present invention to provide a condensate removal means which is so constructed that heat expansion and contraction of the parts will not cause axial displacement of the condensate removal means either axially or radially relative to the drum surface.

It is a further object of the invention to provide an improved mechanism which provides dipper straws with open condensate receiving ends adjacent the inner surface of the shell of a dryer drum wherein the straws are individually divided, or divided in groups, which individual straws or groups are rigidly positioned relative to the inner surface of the shell so that heat expansion of the individual straws or individual groups along a relatively long length of dryer drum does not displace the straws or groups of straws so as to change their effective location with respect to their ability to remove condensate.

Other objects, advantages and features, as well as equivalent structures which are intended to be covered herein, will become more apparent with the teaching of the principles of the invention in connection with the disclosure of the preferred embodiments thereof in the specification, claims and drawings, in which:

DRAWINGS

DESCRIPTION

Figure 5:
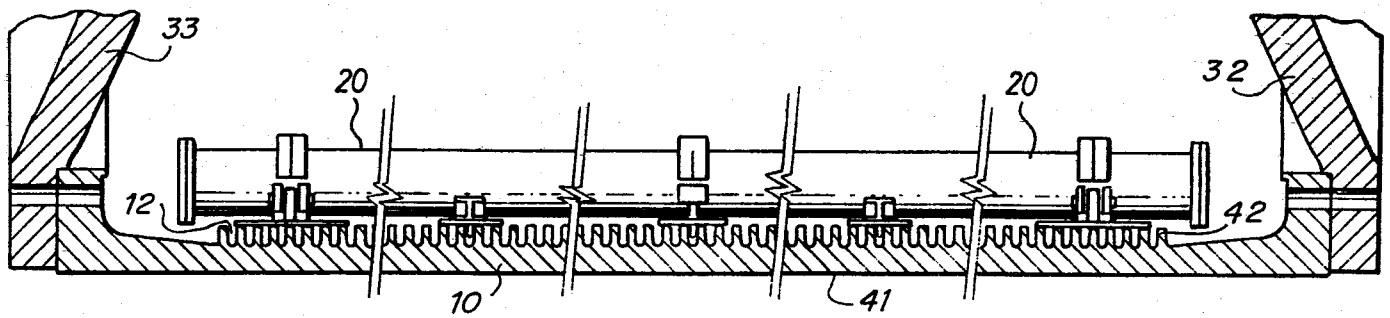
FIG. 5 is a fragmentary section taken along the line V—V of FIG. 3.

In FIG. 5 a portion of a dryer drum, which also may be referred to as a dryer cylinder, is shown with an outer annular shell 10 with heads 32 and 33. The shell has a smooth outer surface 41 and the inner surface 42 has a series of circumferentially extending ribs with grooves 12 therebetween.

The heads 32 and 33 have hubs, not shown, and one of the hubs is provided with a steam inlet fitting for supplying heated steam, indicated by the label "Steam Delivery", to the interior of the drum for heating the shell, and a condensate outlet fitting will also be provided to lead the condensate being removed out through the drum end.

With a very long drum, slight deflection along the length can occur. With the present structural arrangement, an objective is to isolate the condensate removal conduit means leading out through a hub from the small dipper tubes or straws which perform the removal adjacent the inner surface of the shell so that the individual straws retain a fixed position in a radial direction and a fixed position in an axial direction. The straws or tubes have an open outer end and it is essential that the open outer ends of each of the straws remain at the same distance from the inner surface of the drum for throughout its axial length whether it is smooth or grooved (the drawing showing a grooved inner surface). If any of the tubes along the length change in distance from the inner surface of the shell, a change will occur in the thickness of the layer of condensate which will result in a change in temperature of the outer surface of the shell.

It is equally important when a grooved drum is used that the individual straws retain their fixed relative axial position so that they do not rub on the side of the grooves.

Figure 1:
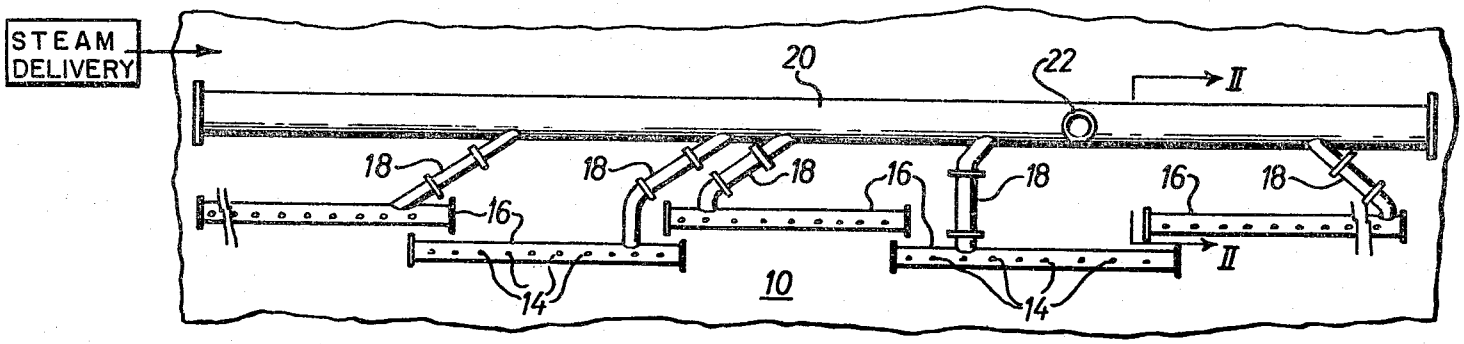
FIG. 1 is a diagrammatic plan view of the inside of a dryer cylinder shell provided with an arrangement according to the invention.
Figure 2:
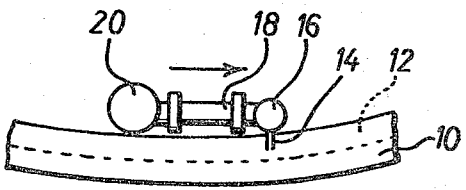
FIG. 2 is a similar schematic view taken along the line II—II of FIG. 1.
Figure 3:
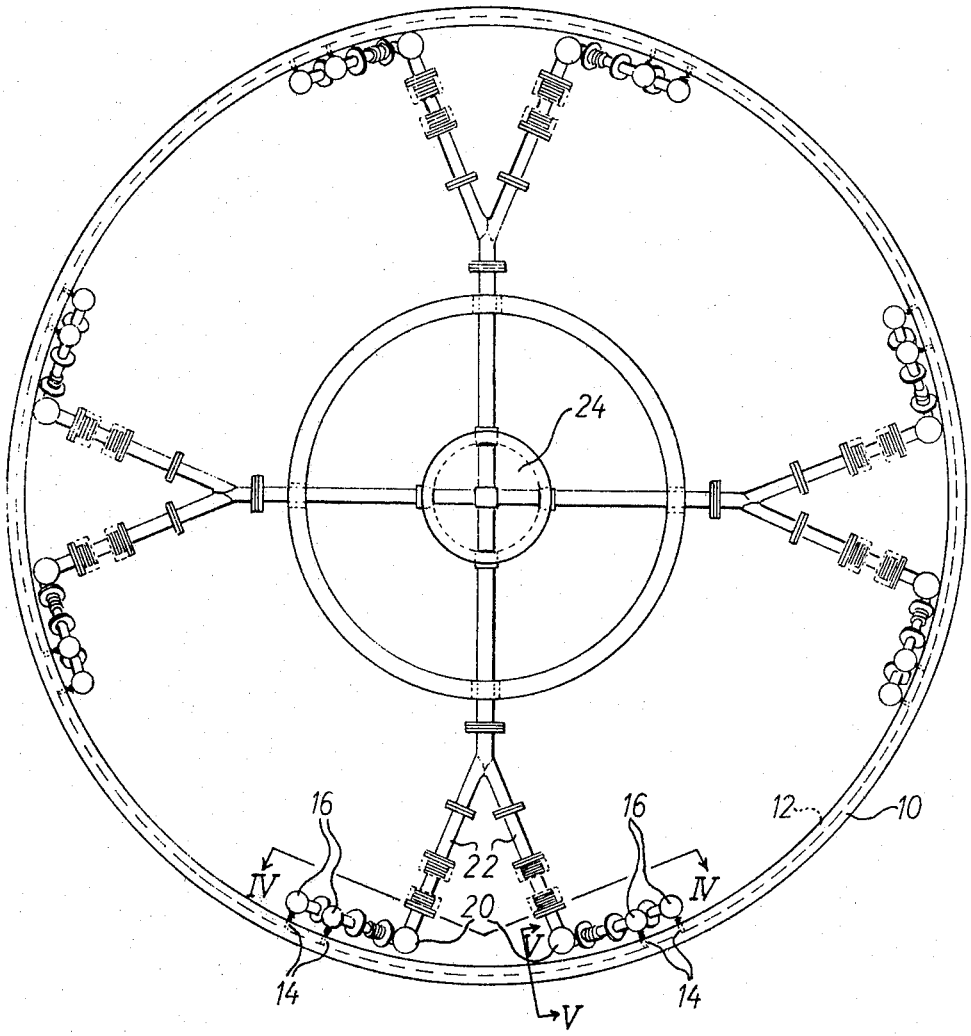
FIG. 3 is an end view along a dryer cylinder shell fitted with an arrangement according to the invention.
Figure 4:
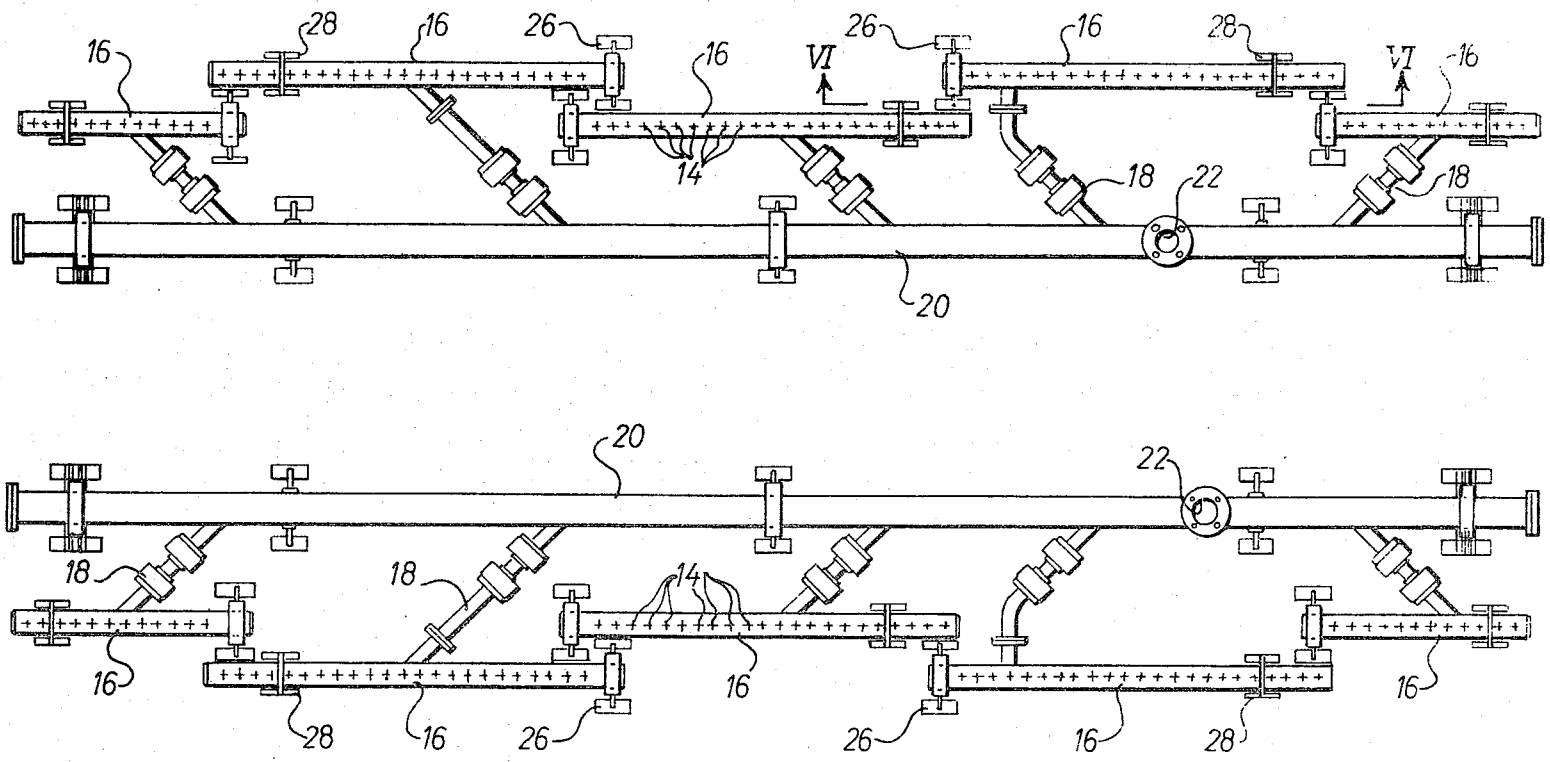
FIG. 4 is a plan view taken along the section line IV—IV of FIG. 3.

Referring to FIG. 1, the internal grooves of a shell 10 have not been shown for the sake of clarity although they are indicated by the reference 12 in FIG. 2. Dipper tubes or straws 14 depend from a plurality of short header tubes 16 each of which is flexibly connected at 18 to a common header pipe 20. As more clearly seen in FIG. 2 the individual dipper tubes or straws 14 are located within grooves 12 formed in the internal surface of the shell 10 so that their inlets are located in the region in which the condensate collects when the dryer is in operation.

A practical arrangement of the invention is shown in FIGS. 3 to 7 and here again it will be seen that the individual dipper tubes 14 are carried from a plurality of short header tubes 16 which are flexibly connected at 18 to common header pipes 20. In turn these header pipes 20 are connected to riser pipes 22 into a condensate discharge 24 extending through the cylinder and leading away out of the cylinder through the usual seals through the hub of the drum.

Figure 7:
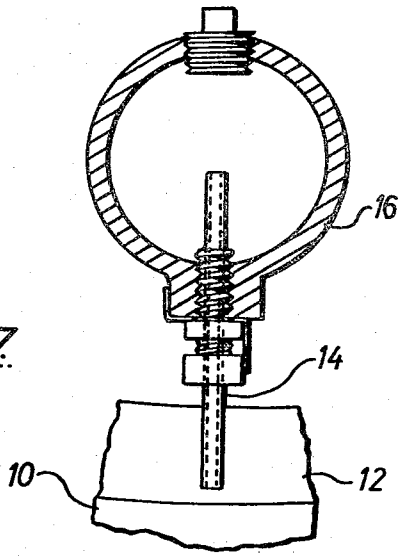
FIG. 7 is an enlarged detail showing a short header tube with associated dipper tubes located in a groove of the shell.
Figure 6:
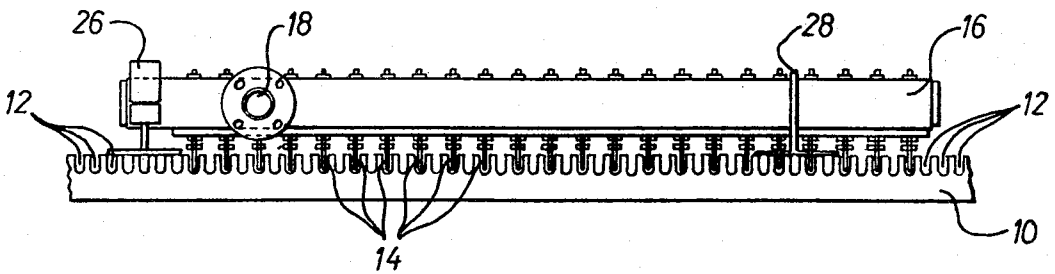
FIG. 6 is a view taken along the line VI—VI of FIG. 4.

As can be clearly seen in FIGS. 6 and 7 the dipper tubes or straws 14 extend into the grooves 12 of the shell 10 and carry the condensate away through systems 20, 22 and 24, normally as a result of an increased pressure existing within the drying cylinder. Because each short header tube 16 extends only partially across the width or axial length of the cylinder it is not susceptible to deformation as it would be if it extended across the whole width and consequently the positioning of the dipper tubes 14 within the grooves 12 is maintained and a constant heat gradient across the surface of the roll in the region of condensate collection is maintained. Moreover, because the common header pipe or conduit 20, extending substantially across the entire width of the cylinder, is joined to the short header tubes 16 by flexible connections 18, any deformation or misalignment of pipe 20 is not transmitted to the tubes 16. The individual short header tubes 16 are held in position by means of clamps 26 and securing brackets 28.

It will be seen that the number and location of the short header tubes 16 (FIG. 4) is such that there is a slight overlap between the ends thereof thereby ensuring that there is a dipper tube provided at each condensate collection region for each groove. From FIGS. 3 and 4 it will be seen that each collection region is provided with two common header pipes at spaced locations subtending an arcuate angle of about 45° and normally four such locations would be provided around the drying cylinder. The short header tubes 16 carried by one of these pipes 20 provide dipper tubes or straws 14 for each alternate groove 12 (FIG. 6), while the short header tubes 16 of the other pipe 20 provide those for the remaining grooves so that each groove has one tube at each of the four locations. As will be seen from the drawings, each dipper straw is initially adjustable in a radial direction so that its open end will be at a fixed dimension from the surface of the bottom of the groove. Once this adjustment is made, because its header is firmly clamped in position, it will retain that position to maintain the predetermined uniform thickness of condensate at the bottom of the groove.

The whole of the condensate removal system described is secured to the inner face of the cylinder and rotates with it.

Thus, it will be seen that I have provided an improved dryer drum assembly and condensate drainage arrangement which meets the objectives and advantages above set forth and provides for uniform temperature along the length of the dryer drum and improvement in the paper web product produced.

I claim as my invention:

1. A dryer drum for a paper making machine comprising in combination:

a rotary mounted hollow cylindrical drum shell with supporting end heads;

means for delivering steam into the interior of the shell for heating the shell and with condensate forming on the inner surface of the shell;

a plurality of relatively short length headers extending generally axially within the drum and uniformly spaced from each other around the circumference of the drum overlapping at their ends;

a row of dipper straws projecting radially outwardly from each of the headers and relatively uniformly spaced therealong with open ends positioned adjacent the inner surface of the shell for withdrawing condensate through the straws up into the headers;

means rigidly mounting the headers in their respective positions to the inner surface of the shell;

means for adjusting the position of the open end of the straws so as to position them uniformly spaced from the inner surface of the shell to maintain a uniform thickness in the layer of condensate rimming the shell surface;

a conduit means extending from within the shell to the exterior thereof for removal of condensate;

and flexible tubes connecting each of the headers to the conduit means for conducting the condensate from the headers to the conduit.

* * * * *